US007122231B2

(12) United States Patent
Sharma et al.

(10) Patent No.: US 7,122,231 B2
(45) **Date of Patent: *Oct. 17, 2006**

(54) INK JET RECORDING ELEMENT

(75) Inventors: Krishamohan Sharma, Rochester, NY (US); Joseph F. Bringley, Rochester, NY (US); Christine Landry-Coltrain, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 435 days.

This patent is subject to a terminal disclaimer.

(21) Appl. No.: 10/180,752

(22) Filed: Jun. 26, 2002

(65) Prior Publication Data

US 2004/0001926 A1 Jan. 1, 2004

(51) Int. Cl.
*B41M 5/00* (2006.01)

(52) U.S. Cl. ..... 428/32.15; 428/32.14; 428/32.34

(58) Field of Classification Search ..... 347/105; 428/32.34, 32.15, 32.14
See application file for complete search history.

(56) References Cited

U.S. PATENT DOCUMENTS

| | | | | |
|---|---|---|---|---|
| 5,372,884 | A | 12/1994 | Abe et al. | |
| 5,500,668 | A * | 3/1996 | Malhotra et al. | 347/105 |
| 5,686,602 | A * | 11/1997 | Farooq et al. | 536/101 |
| 6,506,478 | B1 * | 1/2003 | Schulz | 544/58.5 |
| 6,780,478 | B1 * | 8/2004 | Steiger et al. | 428/32.32 |
| 2005/0013945 | A1 * | 1/2005 | Bringley et al. | 428/32.34 |
| 2005/0014000 | A1 * | 1/2005 | Bringley et al. | 428/403 |

FOREIGN PATENT DOCUMENTS

| | | | |
|---|---|---|---|
| EP | 0391308 | | 10/1990 |
| EP | 0391308 | A1 * | 10/1990 |
| EP | 0 965 460 | A2 | 12/1999 |
| EP | 0963947 | | 12/1999 |
| EP | 1 016 543 | A1 | 7/2000 |
| JP | 04007189 | | 1/1992 |
| JP | 05170425 | | 7/1993 |

* cited by examiner

*Primary Examiner*—Pamela R. Schwartz
(74) *Attorney, Agent, or Firm*—Harold E. Cole; Chris P. Konkol

(57) ABSTRACT

An ink jet recording element comprising a support having thereon an image-receiving layer, the ink jet recording element containing finely divided particulate material and a metal(oxy)hydroxide complex, $M^{n+}(O)_a(OH)_b(A^{p-})_c.xH_2O$, wherein M is at least one metal ion; n is 3 or 4; A is an organic or inorganic ion; p is 1, 2 or 3; and x is equal to or greater than 0; with the proviso that when n is 3, then a, b and c each comprise a rational number as follows: $0 \leqq a < 1.5$; $0 < b < 3$; and $0 \leqq pc < 3$, so that the charge of the $M^{3+}$ metal ion is balanced; and when n is 4, then a, b and c each comprise a rational number as follows: $0 \leqq a < 2$; $0 < b < 4$; and $0 \leqq pc < 4$, so that the charge of the $M^{4+}$ metal ion is balanced.

15 Claims, No Drawings

INK JET RECORDING ELEMENT

CROSS REFERENCE TO RELATED APPLICATIONS

Reference is made to commonly assigned, co-pending U.S. patent applications:

Ser. No. 10/180,184 by Bringley et al., filed of even date herewith entitled "Ink Jet Printing Method";

Ser. No. 10/180,638 by Sharma et al., filed of even date herewith entitled "Ink Jet Recording Element";

Ser. No. 10/180,373 Sharma et al., filed of even date herewith entitled "Ink Jet Recording Element";

Ser. No. 10/180,182 by Sharma et al., filed of even date herewith entitled "Ink Jet Recording Element";

Ser. No. 10/180,187 by Bringley et al., filed of even date herewith entitled "Ink Jet Printing Method" now U.S. Pat. No. 6,984,033;

Ser. No. 10/180,395 by Bringley et al., filed of even date herewith entitled "Ink Jet Printing Method" now U.S. Pat No. 6,991,835; and Ser. No. 10/180,179 by Bringley et al., filed of even date herewith entitled "Ink Jet Recording Element".

FIELD OF THE INVENTION

The present invention relates to an ink jet recording element containing a stabilizer.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An ink jet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of ink jet recording elements is their need to dry quickly after printing. To this end, porous recording elements have been developed which provide nearly instantaneous drying as long as they have sufficient thickness and pore volume to effectively contain the liquid ink. For example, a porous recording element can be manufactured by coating in which a particulate-containing coating is applied to a support and is dried.

When a porous recording element is printed with dye-based inks, the dye molecules penetrate the coating layers. However, there is a problem with such porous recording elements in that the optical densities of images printed thereon are lower than one would like. The lower optical densities are believed to be due to optical scatter that occurs when the dye molecules penetrate too far into the porous layer. Another problem with a porous recording element is that atmospheric gases or other pollutant gases readily penetrate the element and lower the optical density of the printed image causing it to fade. Still another problem occurs from microcracking of the surface of the coated layer that leads to a non-homogeneous coverage of ink in the ink receiving layer. It would be desirable that such coated elements have high gloss, waterfastness and high ink capacity.

EP 1 016 543 relates to an ink jet recording element containing aluminum hydroxide in the form of boehmite. However, there is a problem with this element in that it is not stable to light and exposure to atmospheric gases.

EP 0 965 460A2 relates to an ink jet recording element containing aluminum hydrate having a boehmite structure and a non-coupling zirconium compound. However, there is no specific teaching of a metal oxy(hydroxide) complex as described herein.

U.S. Pat. No. 5,372,884 relates to ink jet recording elements containing a hydrous zirconium oxide. However, there is a problem with such elements in that they tend to fade when subjected to atmospheric gases, as will be shown hereafter.

It is an object of this invention to provide an ink jet recording element that, when printed with dye-based inks, provides superior optical densities, good image quality and has an excellent dry time.

SUMMARY OF THE INVENTION

This and other objects are achieved in accordance with the invention which comprises an ink jet recording element comprising a support having thereon an image-receiving layer, the ink jet recording element containing finely divided particulate material and a metal(oxy)hydroxide complex, $$M^{n+}(O)_a(OH)_b(A^{p-})_c.xH_2O,$$

wherein

M is at least one metal ion;

n is 3 or 4;

A is an organic or inorganic ion;

p is 1, 2 or 3; and x is equal to or greater than 0;

with the proviso that when n is 3, then a, b and c each comprise a rational number as follows: $0 \leqq a < 1.5$; $0 < b < 3$; and $0 \leqq pc < 3$, so that the charge of the $M^{3+}$ metal ion is balanced;

and when n is 4, then a, b and c each comprise a rational number as follows: $0 \leqq a < 2$; $0 < b < 4$; and $0 \leqq pc < 4$, so that the charge of the $M^{4+}$ metal ion is balanced By use of the invention, an ink jet recording element is obtained that, when printed with dye-based inks, provides superior optical densities, good image quality and has an excellent dry time and image stability.

DETAILED DESCRIPTION OF THE INVENTION

In a preferred embodiment of the invention, the stabilizer complex described above is located in the image-receiving layer. In another preferred embodiment, M in the above formula is a Group IIIA, IIIB, WA, WB metal or a lanthanide group metal of the periodic chart, such as tin, titanium, zirconium, aluminum, silica, yttrium, cerium or lanthanum or mixtures thereof. In another preferred embodiment, the stabilizer described above is in a particulate form or is in an amorphous form. In another preferred embodiment, n is 4; a, b and c each comprise a rational number as follows: $0 \leqq a < 1$; $1 < b < 4$; and $1 \leqq pc < 4$, so that the charge of the $M^{4+}$ metal ion is balanced. In still another preferred embodiment, a is 0, n is 4, and b+pc is 4. In yet still another preferred embodiment, a is 0, n is 3, and b+pc is 3.

In yet still another preferred embodiment of the invention, $A^{p-}$ is an organic anion such as R—$COO^-$, R—$O^-$, R—$SO_3^-$, R—$OSO_3^-$ or R—O—$PO_3^-$ where R is an alkyl or aryl group. In another preferred embodiment, $A^{p-}$ is an inorganic anionic such as $I^-$, $Cl^-$, $Br^-$, $F^-$, $ClO_4^-$, $NO_3^-$, $CO_3^{2-}$ or $SO_4^{2-}$. The particle size of the complex described above is less than about 1 μm, preferably less than about 0.1 μm.

Metal (oxy)hydroxide complexes employed herein may be prepared by dissolving a metal salt in water and adjusting the concentration, pH, time and temperature to induce the precipitation of metal (oxy)hydroxide tetramers, polymers or particulates. The conditions for precipitation vary depending upon the nature and concentrations of the counter ion(s) present and can be determined by one skilled in the art. For example, soluble complexes suitable for preparation of the zirconium (oxy)hydroxide particulates include, but are not limited to, $ZrOCl_2$ $8H_2O$, and the halide, nitrate, acetate, sulfate, carbonate, propionate, acetylacetonate, citrate and benzoate salts; and hydroxy salts with any of the above anions. It is also possible to prepare the complexes employed in the invention via the hydrolysis of organically soluble zirconium complexes such as zirconium alkoxides, e.g., zirconium propoxide, zirconium isopropoxide, zirconium ethoxide and related organometallic zirconium compounds.

The hydrolyzed zirconium oxyhydroxides, $$Zr(O)_a(OH)_b(A^{p-})_c{*}xH_2O$$

may exist as tetrameric zirconia units or as polymeric complexes of tetrameric zirconia, wherein zirconium cations are bridged by hydroxy and/or oxo groups. In general, hydrolyzed zirconia salts are amorphous and may exist predominantly in the α form. However, depending upon the experimental conditions (solvents, pH, additives, aging and heating conditions), the hydrolyzed product may contain significant number of "oxo" bridges.

It is often difficult to ascertain the precise composition of "oxo" and "hydroxy" groups in hydrolyzed metal salts. Therefore, the usage of definitive numbers for these functional groups in metal (oxy)hydroxide compositions was avoided. Any number of oligomeric or polymeric units of metal complexes may be condensed via hydrolysis reactions to form larger particulates ranging in size from about 3 nm to 500 nm.

It is further possible to age or heat treat suspensions of the complexes to obtain particulates ranging in size from about 0.500 μm to 5.0 μm. Preferred particles sizes are in the range from about 5 nm to 1000 nm. Calcination of amorphous metal (oxy)hydroxide leads to the formation of crystalline polymorphs of metal oxides.

In a preferred embodiment of the invention, the finely divided particulate material is a water-insoluble inorganic solid or polymeric material, such as a metal oxide or an inorganic mineral. Examples of water-insoluble inorganic solids include any inorganic oxide, such as silica, colloidal silica, fumed silica, alumina, hydrous alumina, colloidal alumina, fumed alumina, calcium carbonate, kaolin, talc, calcium sulfate, natural or synthetic clay, barium sulfate, titanium dioxide, zinc oxide, or mixtures thereof.

Examples of polymeric materials which can be used in the invention as particulate materials include latex particles and core-shell latex particles, such as polyolefins, polyethylene, polypropylene, polystyrene, poly(styrene-co-butadiene), polyurethane, polyester, poly(acrylate), poly(methacrylate), copolymers of n-butylacrylate and ethylacrylate, copolymers of vinylacetate and n-butylacrylate, copolymers of methyl methacrylate and sodium 2-sulfo-1,1-dimethylethyl acrylamide, and copolymers of ethyl acrylate, vinylidene chloride and sodium 2-sulfo-1,1-dimethylethyl acrylamide or mixtures thereof. These polymers can be internally crosslinked or uncrosslinked. It is preferable that uncrosslinked latex particles have a film formation temperature above about 25° C.

The polymeric particles and inorganic particles useful in the invention can be of any size. In a preferred embodiment, the mean particle diameter is less than about 1 μm. Mixtures of organic and inorganic particles may also be used.

In a preferred embodiment of the invention, the image-receiving layer is porous and also contains a polymeric binder in an amount insufficient to alter the porosity of the porous receiving layer. In another preferred embodiment, the polymeric binder is a hydrophilic polymer such as poly (vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, caïTageenan, tragacanth, xanthan, rhamsan and the like. In still another preferred embodiment of the invention, the hydrophilic polymer is poly(vinyl alcohol), hydroxypropyl cellulose, hydroxypropyl methyl cellulose, or a poly(alkylene oxide). In yet still another preferred embodiment, the hydrophilic binder is poly(vinyl alcohol).

In addition to the image-receiving layer, the recording element may also contain a base layer, next to the support, the function of which is to absorb the solvent from the ink. Materials useful for this layer include particles, polymeric binder and/or crosslinker.

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint. In a preferred embodiment, polyethylene-coated paper is employed.

The support used in the invention may have a thickness of from about 50 to about 500 μm, preferably from about 75 to 300 μm. Antioxidants, antistatic agents, plasticizers and other known additives may be incorporated into the support, if desired.

In order to improve the adhesion of the ink-receiving layer to the support, the surface of the support may be subjected to a corona-discharge treatment prior to applying the image-receiving layer.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

In order to impart mechanical durability to an ink jet recording element, crosslinkers that act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include inorganic or organic particles, pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30% active coating aid based on the total solution weight. These coating aids can be nonionic, anionic, cationic or amphoteric. Specific elements are described in MCCUTCHEON's Volume 1: Emulsifiers and Detergents, 1995, North American Edition.

The ink receiving layer employed in the invention can contain one or more mordanting species or polymers. The mordant polymer can be a soluble polymer, a charged molecule, or a crosslinked dispersed microparticle. The mordant can be non-ionic, cationic or anionic.

The coating composition can be coated either from water or organic solvents, however water is preferred. The total solids content should be selected to yield a useful coating thickness in the most economical way, and for particulate coating formulations, solids contents from 10–40% are typical.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following examples are provided to illustrate the invention.

EXAMPLES

Example 1

Dye Stability Evaluation Tests

The dye used for testing was a magenta colored ink jet dye having the structure shown below. To assess dye stability on a given substrate, a measured amount of the ink jet dye and solid particulates or aqueous colloidal dispersions of solid particulates (typically about 10%–20.0% by weight solids) were added to a known amount of water such that the concentration of the dye was about $10^{-5}$ M. The solid dispersions containing dyes were carefully stirred and then spin coated onto a glass substrate at a speed of 1000–2000 rev/min. The spin coatings obtained were left in ambient atmosphere with fluorescent room lighting (about 0.5 Klux) kept on at all times during the measurement. The fade time was estimated by noting the time required for complete disappearance of magenta color as observed by the naked eye or by noting the time required for the optical absorption to decay to less than 0.03 of the original value.

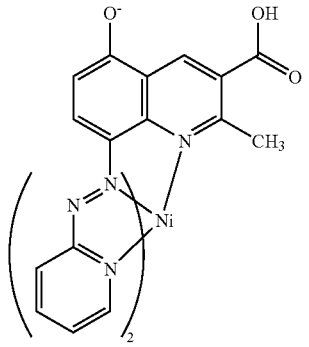

Magenta Dye

Comparative Coatings C-1 to C-13 (Non-metal(oxy)hydroxide Salts)

Inorganic particles of $Al_2O_3$, $SiO_2$, $TiO_2$, ZnO, MgO, $ZrO_2$, $Y_2O_3$, $CeO_2$, $CaCO_3$, $BaSO_4$, $Zn(OH)_2$, laponite and montmorillonite were purchased from commercial sources as fine particles or as colloidal particulate dispersions and were used to evaluate the stability of ink jet dyes in comparison with the materials employed in the present invention. The compositions and chemical identity of the samples was confirmed using powder X-ray diffraction techniques. The particulates were then coated and tested and the results are shown in Table 1.

Comparative Coatings C-14 to C-16 (No Additional Particulates)

C-14. Zr1: $Zr(OH)_b(CH_3COO)_c.xH_2O$: A 10% colloidal dispersion of zirconium(iv)acetate hydroxide was made by adding 1.0 g of the salt in 9 ml of distilled water at room temperature. The resulting colloid is hereafter referred to as "Zr1". The resultant dispersion with pH ca. 4.1 was then coated and tested as described above and the results shown in Table 1 below.

C-15. Zr2: $Zr(O)_a(OH)_b(CH_3COO)_{0.83}(Cl)_{1.17}.xH_2O$: To a 10.0 ml solution of 1M $ZrOCl_2.8H_2O$, 8.3 ml of 1M sodium acetate was gradually added and vigorously stirred at room temperature. The resulting colloid is hereafter referred to as "Zr2". The final colloidal dispersion with (ca. 14% solids) pH ca. 3.0 was then coated and tested as described above and the results shown in Table 1 below.

C-16. Zr3: $Zr(O)_a(OH)_b(Cl)_{1.83}.xH_2O$: To a 10.0 ml solution of 0.5 M $ZrOCl_2.8H_2O$, 1.7 ml of 0.5 M sodium hydroxide was gradually added while vigorously stirring at room temperature. The resulting colloid is hereafter referred to as "Zr3". The resultant colloidal dispersion (ca. 19% solids) with pH 3.6 was then coated and tested as described above and the results shown in Table 1 below.

Inventive Coatings I-1 to I-34

The following dispersions were coated and tested as described above. The results are shown in Table 1 below.

I-1. To a 2.0 g of 40% silica dispersion, 0.04 g of $Zr(OH)_b(CH_3COO)_c.xH_2O$ complex dissolved in 2.0 ml of distilled water was added while vigorously stirring solid dispersion. The final colloidal dispersion with pH 5.1 was used for evaluating the stability of the inkjet dyes.

I-2. To a 2.0 g of 40% silica dispersion, 0.08 g of $Zr(OH)_b(CH_3COO)_c.xH_2O$ complex dissolved in 2.0 ml of distilled water was added while vigorously stirring solid dispersion. The final colloidal dispersion with pH 4.8 was used for evaluating the stability of the inkjet dyes.

I-3. To a 2.0 g of 40% silica dispersion, 0.160 g of $Zr(OH)_b(CH_3COO)_c.xH_2O$ complex dissolved in 2.0 ml of distilled water was added while vigorously stirring solid dispersion. The final colloidal dispersion with pH 4.7 was used for evaluating the stability of the inkjet dyes.

I-4. To a 2.0 g of 40% colloidal silica dispersion, 0.240 g of $Zr(OH)_b(CH_3COO)_c.xH_2O$ complex dissolved in 2.0 ml of distilled water was added while vigorously stirring solid dispersion. The final colloidal dispersion with pH 4.5 was used for evaluating the stability of the inkjet dyes.

I-5. To a 2.0 g of 40% colloidal silica dispersion, 1.0 g of 14% Zr2 dispersion was added while vigorously stirring solid dispersion. The final colloidal dispersion with pH 4.7 was used for evaluating the stability of the inkjet dyes.

I-6. To a 2.0 g of 40% colloidal silica dispersion, 0.16 g of Zr3 complex was added while vigorously stirring solid dispersion. The final colloidal dispersion with pH 4.0 was used for evaluating the stability of the inkjet dyes.

I-7. To a 2.0 g of 40% fumed alumina dispersion, 0.04 g of $Zr(OH)_b(CH_3COO)_c.xH_2O$ complex dissolved in 2.0 ml of distilled water was added while vigorously stirring solid dispersion. The final colloidal dispersion with pH 4.7 was used for evaluating the stability of the inkjet dyes.

I-8. To a 2.0 g of 40% fumed alumina dispersion 0.08 g of $Zr(OH)_b(CH_3COO)_c.xH_2O$ complex dissolved in 2.0 ml of distilled water was added while vigorously stirring solid dispersion. The final colloidal dispersion with pH 4.2 was used for evaluating the stability of the inkjet dyes.

I-9. To a 2.0 g of 40% fumed alumina dispersion, 0.16 g of $Zr(OH)_b(CH_3COO)_c.xH_2O$ complex dissolved in 2.0 ml of distilled water was added while vigorously stirring solid dispersion. The final colloidal dispersion with pH 4.2 was used for evaluating the stability of the inkjet dyes.

I-10. To a 2.0 g of 40% fumed alumina dispersion 0.240 g of $Zr(OH)_b(CH_3COO)_c.xH_2O$ complex dissolved in 2.0 ml of distilled water was added while vigorously stirring solid dispersion. The final colloidal dispersion with pH 4.2 was used for evaluating the stability of the inkjet dyes.

I-11. To a 2.0 g of 40% fumed alumina dispersion 1.0 g of 14% Zr2 dispersion was added while vigorously stirring solid dispersion. The final colloidal dispersion with pH 4.3 was used for evaluating the stability of the inkjet dyes.

I-12. To a 2.0 g of fumed alumina dispersion 0.16 g of Zr3 complex dissolved in 2.0 ml of distilled water was added while vigorously stirring solid dispersion. The final colloidal dispersion with pH 5.0 was used for evaluating the stability of the inkjet dyes.

I-13. To a 0.4 g of titanium dioxide nanoparticles, 0.10 g of $Zr(OH)_b(CH_3COO)_c.xH_2O$ complex dissolved in 2.0 ml of distilled water was added while vigorously stirring solid dispersion. The final colloidal dispersion with pH 4.4 was used for evaluating the stability of the inkjet dyes.

I-14. To a 0.4 g of titanium dioxide nanoparticles, 0.8 g of 14% Zr2 dispersion was added while vigorously stirring solid dispersion. The final colloidal dispersion with pH 4.4 was used for evaluating the stability of the inkjet dyes.

I-15. To a 0.4 g of zinc oxide nanoparticles, 0.10 g of $Zr(OH)_b(CH_3COO)_c.xH_2O$ complex was added while vigorously stirring solid dispersion. The final colloidal dispersion with pH 6.6 was used for evaluating the stability of the inkjet dyes.

I-16. To a 0.4 g of zinc dioxide nanoparticles, 0.8 g of 14% Zr2 dispersion was added while vigorously stirring solid dispersion. The final colloidal dispersion with pH 6.8 was used for evaluating the stability of the inkjet dyes.

I-17. To a 0.4 g of magnesium oxide fine particulates, 0.10 g of $Zr(OH)_b(CH_3COO)_c.xH_2O$ complex was added while vigorously stirring solid dispersion. The final colloidal dispersion containing with pH 9.9 was used for evaluating the stability of the inkjet dyes.

I-18. To a 0.4 g of magnesium oxide fine particulates, 0.8 g of 14% Zr2 dispersion was added while vigorously stirring solid dispersion. The final colloidal dispersion with pH 9.9 was used for evaluating the stability of the inkjet dyes.

I-19. To a 0.4 g of calcium carbonate fine particulates, 0.10 g of $Zr(OH)_b(CH_3COO)_c.xH_2O$ complex was added while vigorously stirring solid dispersion. The final colloidal dispersion with pH 7.0 was used for evaluating the stability of the inkjet dyes.

I-20. To a 0.4 g of calcium carbonate fine particulates, 0.8 g of 14% Zr2 dispersion was added while vigorously stirring solid dispersion. The final colloidal dispersion with pH 6.7 was used for evaluating the stability of the inkjet dyes.

I-21. To a 2.0 g of 36% barium sulfate dispersion, 0.10 g of $Zr(OH)_b(CH_3COO)_c.xH_2O$ complex was added while vigorously stirring solid dispersion. The final colloidal dispersion with pH 5.4 was used for evaluating the stability of the inkjet dyes.

I-22. To a 2.0 g of 36% barium sulfate dispersion, 0.8 g of 14% Zr2 dispersion was added while vigorously stirring solid dispersion. The final colloidal dispersion with pH 4.8 was used for evaluating the stability of the inkjet dyes.

I-23. To a 2.0 g of 30% crystalline zirconia dispersion, 0.05 g of $Zr(OH)_b(CH_3COO)_c.xH_2O$ complex was added while vigorously stirring solid dispersion. The final colloidal with pH 5.0 was used for evaluating the stability of the inkjet dyes.

I-24. To a 2.0 g of 30% zirconia dispersion, 0.45 g of 14% Zr2 dispersion was added while vigorously stirring solid dispersion. The final colloidal dispersion with pH 5.0 was used for evaluating the stability of the inkjet dyes.

I-25. To a 0.4 g of yttria fine particulates, 0.1 g of $Zr(OH)_b(CH_3COO)_c.xH_2O$ complex was added while vigorously stirring solid dispersion. The final colloidal with pH 9.2 was used for evaluating the stability of the inkjet dyes.

I-26. To a 0.4 g of yttria fine particulates, 0.8 g of 14% Zr2 dispersion was added while vigorously stirring solid dispersion. The final colloidal dispersion with pH 9.5 was used for evaluating the stability of the inkjet dyes.

I-27. To a 0.6 g of cerium oxide fine particulates, 0.10 g of $Zr(OH)_b(CH_3COO)_c.xH_2O$ complex was added while vigorously stirring solid dispersion. The final colloidal dispersion with pH 4.8 was used for evaluating the stability of the inkjet dyes.

I-28. To a 0.6 g of cerium oxide fine particulates, 0.8 g of 14% Zr2 dispersion was added while vigorously stirring solid dispersion. The final colloidal dispersion with pH 4.5 was used for evaluating the stability of the inkjet dyes.

I-29. To a 0.4 g of laponite clay, 0.10 g of $Zr(OH)_b(CH_3COO)_c.xH_2O$ complex was added while vigorously stirring solid dispersion. The final colloidal dispersion with pH 7.6 was used for evaluating the stability of the inkjet dyes.

I-30. To a 0.4 g of laponite clay, 0.8 g of 14% Zr2 dispersion was added while vigorously stirring solid dispersion. The final colloidal dispersion with pH 7.7 was used for evaluating the stability of the inkjet dyes.

I-31. To a 0.4 g of montmorillonite clay, 0.10 g of $Zr(OH)_b(CH_3COO)_c.xH_2O$ complex was added while vigorously stirring solid dispersion. The final colloidal dispersion with pH 4.5 was used for evaluating the stability of the inkjet dyes.

I-32. To a 0.4 g of montmorillonite clay, 0.8 g of 14% Zr2 dispersion was added while vigorously stirring solid dispersion. The final colloidal dispersion containing with pH 4.2 was used for evaluating the stability of the inkjet dyes.

I-33. To a 0.4 g of zinc hydroxide, 0.10 g of $Zr(OH)_b(CH_3COO)_c.xH_2O$ complex was added while vigorously stirring solid dispersion. The final colloidal dispersion with pH 6.0 was used for evaluating the stability of the inkjet dyes.

I-34. To a 0.4 g of zinc hydroxide, 0.8 g of 14% Zr2 dispersion was added while vigorously stirring solid dispersion. The final colloidal dispersion containing with pH 5.7 was used for evaluating the stability of the inkjet dyes.

TABLE 1

| Coating | Particle(s) | Fade Time | Hue Change |
|---|---|---|---|
| C-1 | $Al_2O_3$ | 18 hours | No |
| C-2 | $SiO_2$ | 18 hours | No |
| C-3 | $TiO_2$ | 18 hours | No |
| C-4 | ZnO | 2 days | No |
| C-5 | MgO | 18 hours | No |
| C-6 | $ZrO_2$ | 18 hours | No |
| C-6 | $Y_2O_3$ | 7 days | No |
| C-8 | $CeO_2$ | 7 days | No |
| C-9 | $CaCO_3$ | 5 days | Yes |
| C-10 | $BaSO_4$ | 6 days | Yes |
| C-11 | $Zn(OH)_2$ | 5 days | Yes |
| C-12 | Laponite | 4 days | No |
| C-13 | Montmorillonite | 18 hours | Yes |
| C-14 | $Zr(OH)_b(CH_3COO)_c.xH_2O$, $_{b+c=4}$ | >30 days | No |
| C-15 | $Zr(O)_a(OH)_bCH_3CH_2COO)_{083}.(Cl)_{117}.xH_2O$ | >30 days | No |

TABLE 1-continued

| Coating | Particle(s) | Fade Time | Hue Change |
|---|---|---|---|
| C-16 | $Zr(O)_a(OH)_b(Cl)_{183}.xH_2O$ | >30 days | No |
| I-1 | $SiO_2$:Zr1 (20:1) | 16 days | No |
| I-2 | $SiO_2$:Zr1 (10:1) | 18 days | No |
| I-3 | $SiO_2$:Zr1 (5:1) | 18 days | No |
| I-4 | $SiO_2$:Zr1 (3.33:1) | 18 days | No |
| I-5 | $SiO_2$:Zr2 (5.7:1) | >30 days | No |
| I-6 | $SiO_2$:Zr3 (5:1) | 15 days | Yes |
| I-7 | $Al_2O_3$:Zr1 (20:1) | 10 days | No |
| I-8 | $Al_2O_3$:Zr1 (10:1) | 15 days | No |
| I-9 | $Al_2O_3$:Zr1 (5:1) | 15 days | No |
| I-10 | $Al_2O_3$:Zr1 (3.33:1) | 15 days | No |
| I-11 | $Al_2O_3$:Zr2 (5.7:1) | >30 days | No |
| I-12 | $Al_2O_3$:Zr3 (5:1) | 10 days | Yes |
| I-13 | $TiO_2$:Zr1 (4:1) | 7 days | No |
| I-14 | $TiO_2$:Zr2 (3.6:1) | 25 days | No |
| I-15 | ZnO:Zr1 (4:1) | 7 days | No |
| I-16 | ZnO:Zr2 (3.6:1) | >30 days | No |
| I-17 | MgO:Zr1 (4:1) | >30 days | No |
| I-18 | MgO:Zr2 (3.6:1) | >30 days | No |
| I-19 | $CaCO_3$:Zr1 (4:1) | >30 days | No |
| I-20 | $CaCO_3$:Zr2 (3.6:1) | >30 days | No |
| I-21 | $BaSO_4$:Zr1 (7.2:1) | 25 days | No |
| I-22 | $BaSO_4$:Zr2 (6.4:1) | 10 days | No |
| I-23 | $ZrO_2$:Zr1 (12:1) | 9 days | No |
| I-24 | $ZrO_2$:Zr2 (9.5:1) | 7 days | No |
| I-25 | $Y_2O_3$:Zr1 (4:1) | >30 days | No |
| I-26 | $Y_2O_3$:Zr2 (3.6:1) | >30 days | No |
| I-27 | $CeO_2$:Zr1 (6:1) | >30 days | No |
| I-28 | $CeO_2$:Zr2 (5.3:1) | >30 days | No |
| I-29 | Laponite:Zr1 (10:1) | >30 days | No |
| I-30 | Laponite:Zr2 (3.6:1) | >30 days | No |
| I-31 | Montmorillonite:Zr (1 4:1) | 15 days | Yes |
| I-32 | Montmorillonite:Zr2 (3.6:1) | 15 days | Yes |
| I-33 | $Zn(OH)_2$:Zr1 (4.1) | 18 days | No |
| I-34 | $Zn(OH)_2$:Zr2 (3.6:1) | 30 days | No |

The above results show that the mixture of particulates and complexes employed in the present invention provide superior image stability and stabilize the ink jet dye against fade and hue changes, particularly when compared to the control materials C-1 through C-13.

Example 2

Element 1

A coating composition was prepared from 20.9 wt. % of an aqueous dispersion of zirconium(oxy)hydroxyacetate (a 20 wt. % aqueous dispersion from Alfa Aesar, lot # D03K29; 0.005–0.01 μm particles), 41.8 wt. % of a fumed alumina solution (40 wt. % alumina in water, Cab-O-Sperse® PG003 from Cabot Corporation), 3.1 wt. % poly(vinyl alcohol) (PVA) (Gohsenol® GH-23 from Nippon Gohsei Co.), and 34.2 wt. % water. [The relative proportions of zirconia to alumina are 20/80, and the amount of PVA is 13.0 wt % of all solids]. The solution was metered to a slot-die coating apparatus and coated onto a stationary base support comprised of a polyethylene resin coated photographic paper stock, which had been previously subjected to corona discharge treatment, and dried to remove substantially all solvent components to form the ink receiving layer.

Element 2

This element was prepared the same as Element 1 except that the coating composition was 13.1 wt. % of Zr100/20 (a 20 wt. % aqueous colloidal suspension of zirconia nitrate (from Nyacol® Nano Technologies, Inc), 26.1 wt. % of a fumed alumina solution (40 wt. % alumina in water, Cab-O-Sperse® PG003 from Cabot Corporation), 1.9 wt. %

PVA, (Gohsenol® GH-23 from Nippon Gohsei Co.), and 58.9 wt. % water. [The relative proportions of zirconia to alumina are 20/80, and the amount of PVA is 13.0 wt % of all solids].

Element 3

This element was prepared the same as Element 1 except that the coating composition was 61.2 wt. % of the aqueous dispersion of zirconium(oxy)hydroxyacetate, 3.3 wt. % of silica (a 40 wt. % aqueous colloidal suspension of Nalco2329® (75 nm silicon dioxide particles) from Nalco Chemical Co.), 2.4 wt. % PVA, (Gohsenol® GH-23 from Nippon Gohsei Co.), and 33.1 wt. % water. [The relative proportions of zirconia to silica are 90/10, and the amount of PVA is 15.0 wt % of all solids].

Element 4

This element was prepared the same as Element 1 except that the coating composition was 54.3 wt. % of the aqueous dispersion of zirconium(oxy)hydroxyacetate, 6.8 wt. % of silica (a 40 wt. % aqueous colloidal suspension of Nalco2329® (75 nm silicon dioxide particles) from Nalco Chemical Co.), 2.4 wt. % PVA, (Gohsenol® GH-23 from Nippon Gohsei Co.), and 36.5 wt. % water. [The relative proportions of zirconia to silica are 80/20, and the amount of PVA is 15.0 wt % of all solids].

Element 5

This element was prepared the same as Element 1 except that the coating composition was 6.8 wt. % of the aqueous dispersion of zirconium(oxy)hydroxyacetate, 30.7 wt. % of a fumed alumina solution (40 wt. % alumina in water, Cab-O-Sperse® PG003 from Cabot Corporation), 2.4 wt. % PVA, (Gohsenol® GH-23 from Nippon Gohsei Co.), and 60.1 wt. % water. [The relative proportions of zirconia to alumina are 10/90, and the amount of PVA is 15.0 wt % of all solids].

Element 6

This element was prepared the same as Element 1 except that the coating composition was 13.7 wt. % of the aqueous dispersion of zirconium(oxy)hydroxyacetate, 27.2 wt. % of a fumed alumina solution (40 wt. % alumina in water, Cab-O-Sperse® PG003 from Cabot Corporation), 2.4 wt. % PVA, (Gobsenol® GH-23 from Nippon Gohsei Co.), and 56.7 wt. % water. [The relative proportions of zirconia to alumina are 20/80, and the amount of PVA is 15.0 wt % of all solids].

Comparative Element C-1

This element was prepared the same as Element 1 except that the coating composition was 15.7 wt. % of a fumed Zirconia (a 30 wt. % aqueous suspension from Degussa, lot # 007-80, ID # 1TM106), 47.0 wt. % of a fumed alumina solution (40 wt. % alumina in water, Cab-O-Sperse® PG003 from Cabot Corporation), 3.5 wt. % PVA, (Gohsenol® GH-23 from Nippon Gohsei Co.), and 33.8 wt. % water. [The relative proportions of zirconia to alumina are 20/80, and the amount of PVA is 13.0 wt % of all solids].

Comparative Element C-2

This element was prepared the same as Element 1 except that the coating composition 63.1 wt. % of a fumed alumina solution (40 wt. % alumina in water, Cab-O-Sperse® PG003 from Cabot Corporation), 3.8 wt. % PVA (Gohsenol® GH-23 from Nippon Gohsei Co.), and 33.1 wt. % water. [The relative proportions of alumina to PVA are therefore 87/13 by weight].

Comparative Element C-3

This element was prepared the same as Element 1 except that the coating composition was 74.0 wt. % of the aqueous dispersion of zirconium(oxy)hydroxyacetate, 2.2 wt. % PVA (Gohsenol® GH-17 from Nippon Gohsei Co.), and 23.8 wt. % water. [The relative proportions of zirconia to PVA are therefore 87/13 by weight].

Comparative Element C-4

This element was prepared the same as Element 1 except that the coating composition was 34.0 wt. % of silica (a 40 wt. % aqueous colloidal suspension of Nalco2329® (75 nm silicon dioxide particles) from Nalco Chemical Co.), 2.4 wt. % PVA, (Gohsenol® GH-23 from Nippon Gohsei Co.), and 63.6 wt. % water. [The relative proportions of silica to PVA are 85/15].

Comparative Element C-5

This element was prepared the same as Element 1 except that the coating composition was 68.0 wt. % of the aqueous dispersion of zirconium(oxy)hydroxyacetate, 2.4 wt. % PVA, (Gohsenol® GH-23 from Nippon Gohsei Co.), and 29.6 wt. % water. [The relative proportions of zirconia to PVA are 85/15].

Comparative Element C-6

This element was prepared the same as Element 1 except that the coating composition was 34.0 wt. % of a fumed alumina solution (40 wt. % alumina in water, Cab-O-Sperse® PG003 from Cabot Corporation), 2.4 wt. % PVA, (Gohsenol® GH-23 from Nippon Gohsei Co.), and 63.6 wt. % water. [The relative proportions of alumina to PVA are 85/15].

Printing and Dye Stability Testing

The above elements and control elements of Example 1 were printed using a Lexmark Z51 inkjet printer and a cyan inkjet ink, prepared using a standard formulation with a copper phthalocyanine dye (Clariant Direct Turquoise Blue FRL-SF), and a magenta ink, prepared using a standard formulation with Dye 6 from U.S. Pat. No. 6,001,161. (This is the same dye as shown in the structure at the beginning of the examples). The red channel density (cyan) patches and green channel density (magenta) patches at D-max (the highest density setting) were read using an X-Rite® 820 densitometer. The printed elements were then subjected to 4 days exposure to a nitrogen flow containing 5 ppm ozone. The density of each patch was read after the exposure test using the X-Rite® 820 densitometer. The % dye retention was calculated as the ratio of the density after the exposure test to the density before the exposure test. The results for cyan and magenta D-max are reported in Table 2.

TABLE 2

| Element | Compostion of Image Receiving Layer | Cracking | % dye retention magenta D-max | % dye retention cyan D-max |
|---|---|---|---|---|
| 1 | 17.4% ZrO(OH)acetate, 69.6% $Al_2O_3$ 13% PVA | Moderate | 64 | 82 |
| 2 | 17.4% ZrO(OH)nitrate 69.6% $Al_2O_3$ 13% PVA | None | 55 | 71 |
| 3 | ZrO(OH)acetate/ silica 90/10 | Moderate | 99 | 100 |
| 4 | ZrO(OH)acetate/ silica 80/20 | Severe | 99 | 100 |

TABLE 2-continued

| Element | Compostion of Image Receiving Layer | Cracking | % dye retention magenta D-max | % dye retention cyan D-max |
|---|---|---|---|---|
| 5 | ZrO(OH)acetate/ alumina 10/90 | None | 99 | 99 |
| 6 | ZrO(OH)acetate/ alumina 20/80 | Slight | 98 | 100 |
| C-1 | 17.4% crystalline $ZrO_2$ 69.6% $Al_2O_3$ 13% PVA | None | 4 | 46 |
| C-2 | 87% $Al_2O_3$ 13% PVA | None | 3 | 53 |
| C-3 | 87% ZrO(OH)acetate 13% PVA | Severe | 96 | 100 |
| C-4 | Silica | None | 6 | 77 |
| C-5 | ZrO(OH)acetate, | Severe | 98 | 100 |
| C-6 | alumina | None | 13 | 83 |

The above results show that the elements of the invention had acceptable physical properties and superior dye retention as compared to the control elements that had either severe cracking or poor dye retention.

Although the invention has been described in detail with reference to certain preferred embodiments for the purpose of illustration, it is to be understood that variations and modifications can be made by those skilled in the art without departing from the spirit and scope of the invention.

What is claimed is:

1. An ink jet recording element comprising a support having thereon a porous image-receiving layer comprising a polymeric binder, said porous image-receiving layer containing finely divided particulate material and, in addition, a metal(oxy)hydroxide complex coated in particulate form, $$M^{n+}(O)_a(OH)_b(A^{p-})_c.xH_2O$$

wherein $M^{n+}$ is at least one metal ion wherein M is a Group IVA, IVB metal or a lanthanide group metal of the periodic chart;

n is;

$A^{p-}$is present and either is an inorganic anion selected from the group consisting of $I^-$, $Cl^-$, $Br^{--}$, $F^-$, $ClO_4^-$, $NO_3^-$, $CO_3^{2-}$ and $SO_4^{2-}$ or $A^{p-}$ is an organic anion;

p is 1,2 or 3; and x is equal to or greater than 0;

with the proviso that when n is 4, then a, b and c each comprise a rational number as follows: $0<a<2$; $0<b<4$; and $0<pc\leqq 4$, so that the charge of the $M^{4-}$ metal ion is balanced, wherein said finely divided particulate material is silica, colloidal silica, fumed silica, alumina, hydrous alumina, colloidal alumina, fumed alumina, calcium carbonate, kaolin, talc, calcium sulfate, natural or synthetic clay, barium sulfate, titanium dioxide or zinc oxide.

2. The recording element of claim 1 wherein M is tin, titanium, zirconium, silica, or mixtures thereof.

3. The recording element of claim 1 wherein $A^{p-}$ is an organic anion $R—COO^-$, $R—O^-$, $R—SO_3^{31}$, $R—OSO_3^-$ or $R—O—PO_3^-$ where R is an alkyl or aryl group.

4. The recording element of claim 1 wherein said finely divided particulate material is a water-insoluble inorganic solid or polymeric material.

5. The recording element of claim 4 wherein said water-insoluble inorganic solid is a metal oxide or an inorganic mineral.

6. The recording element of claim 5 wherein said metal oxide or inorganic mineral is silica, colloidal silica, fumed silica, alumina, hydrous alumina, colloidal alumina, fumed alumina, calcium carbonate, kaolin, talc, calcium sulfate, natural or synthetic clay, barium sulfate, titanium dioxide or zinc oxide.

7. The recording element of claim 5 wherein said complex is amorphous.

8. The recording element of claim 5 wherein $A^{p-}$ is $Cl^-$, $NO_3^-$, $CO_3^{2-}$, acetate or propionate.

9. The recording element of claim 4 wherein said polymeric material is a latex particle.

10. The recording element of claim 1 wherein M is Zr.

11. The recording element of claim 1 wherein a, b and c each comprise a rational number as follows: $0<a<1$; $1<b<4$; and $1\leqq pc<4$, so that the charge of the $M^{4+}$ metal ion is balanced.

12. The recording element of claim 1 wherein the particle size of said complex is less than about 1 μm.

13. The recording element of claim 1 wherein said support is opaque.

14. The recording element of claim 1 that also includes a base layer located between said image-receiving layer and said support.

15. An ink jet recording element comprising a support having thereon a porous image-receiving layer comprising a polymeric binder, said porous image-receiving layer containing finely divided particulate material and, in addition, a metal(oxy)hydroxide complex coated in particulate form, $$M^{n+}(O)_a(OH)_b(A^{p-})_c.xH_2O$$

wherein $M^{n+}$ is at least one metal ion wherein M is a Group IVA, IVB metal or a lanthanide group metal of the periodic chart;

n is;

$A^{p-}$ is an organic ion;

p is 1,2 or 3; and x is equal to or greater than 0;

with the proviso that when n is 4, then a, b and c each comprise a rational number as follows: $0<a<2$; $0<b<4$; and $0<pc\leqq 4$, so that the charge of the $M^{4+}$ balanced.

* * * * *

UNITED STATES PATENT AND TRADEMARK OFFICE

CERTIFICATE OF CORRECTION

PATENT NO. : 7,122,231 B2
APPLICATION NO. : 10/180752
DATED : October 17, 2006
INVENTOR(S) : Krishamohan Sharma et al.

It is certified that error appears in the above-identified patent and that said Letters Patent is hereby corrected as shown below:

Column 13, line 43, after "n is" insert -- 4 --.

Column 13, line 51, after "the charge of the" delete "$M^{4-}$" and insert -- $M^{4+}$ --.

Column 14, line 4, delete "$R\text{-}SO_3^{31}$" and insert -- $R\text{-}SO_3^{-}$ --.

Column 14, line 49, after "n is" insert -- 4 --.

Column 14, line 55, after "$M^{4+}$" and before "balanced" insert -- metal ion is --.

Signed and Sealed this

Tenth Day of July, 2007

JON W. DUDAS
*Director of the United States Patent and Trademark Office*